United States Patent [19]

Miyamichi et al.

[11] Patent Number: 4,723,959

[45] Date of Patent: Feb. 9, 1988

[54] NON-INFLAMMABLE FIBER MATERIALS AND PROCESS FOR PRODUCING THE SAME

[75] Inventors: Kazuo Miyamichi, Tokyo; Takeo Yokota, Hyogo; Kazumaro Hanaki, Osaka, all of Japan

[73] Assignee: Nitto Boseki Co., Ltd., Japan

[21] Appl. No.: 795,541

[22] Filed: Nov. 6, 1985

[30] Foreign Application Priority Data

Nov. 7, 1984 [JP] Japan ..... 59-234384

[51] Int. Cl.[4] ..... D06M 9/00

[52] U.S. Cl. ..... 8/115.7; 427/227; 427/270; 423/447.6; 423/447.9

[58] Field of Search ..... 8/115.7; 427/227, 270; 423/447.6, 447.9

[56] References Cited

U.S. PATENT DOCUMENTS 3,639,140 2/1972 Miyamichi ..... 8/195

3,661,616 5/1972 Miyamichi ..... 8/195

*Primary Examiner*—Paul Lieberman

*Assistant Examiner*—John F. McNally

*Attorney, Agent, or Firm*—Gerald J. Ferguson, Jr.; Michael P. Hoffman; Michael J. Foycik, Jr.

[57] ABSTRACT

A non-inflammable fiber material and a process for producing the same are disclosed, said process comprising the steps of:

obtaining thready materials, knitted goods, or woven goods, which are composed of a mixed yarn consisting of polymetaphenylene isophthalamide fibers of thermal decomposition temperature not smaller than 350° C. and rayon fibers, or which are composed of 100 weight parts of a mixed yarn consisting of polymetaphenylene isophthalamide fibers of thermal decomposition temperature not smaller than 350° C. and rayon fibers, and from 20 to 100 weight parts of a polymetaphenylene isophthalamide fiber yarn of thermal decomposition temperature not smaller than 350° C., at least said rayon fibers in said thready materials, knitted goods, or woven goods being treated with one or more chemical agents selected from a first chemical agent group consisting of ammonium sulfamate, diammonium imidodisulfonate, ammonium sulfate, ammonium bisulfate, ammonium thiosulfate, ammonium sulfite, and ammonium bisulfite, and one or more chemical agents selected from a second chemical agent group consisting of ammonium dihydrogen phosphate, diammonium hydrogen phosphate, and guanidine phosphate; and heat treating said thready materials, said knitted goods, or said woven goods at from 200 to 260° C. so as to denaturate said rayon fibers in said thready material, said knitted goods, or said woven goods into thermally decomposed heat treated carbonized fibers.

4 Claims, No Drawings

NON-INFLAMMABLE FIBER MATERIALS AND PROCESS FOR PRODUCING THE SAME

FIELD OF THE INVENTION

The present invention relates to a non-inflammable fiber materials and a process for producing the same. More particularly, it relates to a process for producing knitted goods, woven goods, or thready materials, which are provided with properties improved not only in flame resistance but also in mechanical properties such as tensile strength, tear strength, and so on, and which are to be processed into, for example, fire-proof or heat-insulating curtains, heat-proof defensive suits, gloves for fire-fighting, fire-fighting suits, sailor hammocks, etc.

BACKGROUND OF THE INVENTION

Generally, as fiber materials used in the field where flame resistance is required, for example, there are an asbestos sheet; a ceramic sheet; a glass fiber sheet and a glass fiber thready material; a metal fiber sheet; a metal fiber thready material; and the like. With respect to the asbestos sheet, it has been clearly found that a raw material thereof causes, particularly, a lung cancer, and therefore in the present circumstances, the asbestos sheet has a tendency to be limited in use in various countries. The ceramic sheet is not satisfying pricewise because the cost of the material thereof is so high, although the ceramic sheet has a superior fire-resistant property. The glass fiber sheet and glass fiber thready material have such a problem that borings may be caused due to fusion although they never inflame, and moreover they have not been improved in a fatigue-resistant property against a repeated load. Further, the metal fiber sheet and metal fiber thready material have a disadvantage that they have a very high rigidity and therefore they are not suitable as non-inflammable fiber materials for use in the field where flexibility is required. Therefore, as a practical matter, there is no material which satisfies the requirement for the non-inflammable fiber materials for use in the field where the fatigue-resistant property and the flexibility are required.

Furthermore, as a process for producing thready materials, knitted goods, or woven good, made of rayon fibers which are made non-inflammable, there has been proposed a process in which thready materials, knitted goods, or woven goods, comprising rayon fibers treated with at least one chemical agent selected from a first chemical agent group (a strength increasing agent) consisting of ammonium sulfamate, diammonium imidodisulfonate, ammonium sulfate, ammonium bisulfate, ammonium thiosulfate, ammonium sulfite, and ammonium bisulfite, and at least one chemical agent selected from a second chemical agent group (a flame resistance-improving agent) consisting of ammonium dihydrogen phosphate, diammonium hydrogen phosphate, and guanidine phosphate, are heat treated at from 200° to 260° C. so as to denaturate the rayon fibers into thermally decomposed heat treated carbonized fibers.

The thus treated thready materials, knitted goods, or woven goods are improved in tensile strength because the rayon fibers are prevented from being reduced by burning during the heat treatment step, and moreover they have flame resistance so that they never inflame even if they are made to come into contact with an oxygen-acetylene flame. However, they have such a disadvantage that they are so poor in tear strength that troubles due to insufficient tear strength may occur frequently when they are practically used.

SUMMARY OF THE INVENTION

It is an object of the present invention to provide non-inflammable fiber materials which eliminate the disadvantages in the prior art as described above.

It is another object of the present invention to provide a process for producing non-inflammable fiber materials comprising the steps as defined in the appended claims.

It is a further object of the present invention to provide a process for producing non-inflammable fiber materials, such as thready materials, knitted goods, or woven goods, by using the heat-resistant and mechanical strength properties of polymetaphenylne isophthalamide fibers which are non-fusible organic fibers having a thermal decomposition temperature not smaller than 350° C., the fire and heat-resistant properties of carbonized fibers obtained by subjecting rayon fibers to thermally decomposing heat treatment, and the flexibility property of both of the two kinds of fibers.

It is a still further object of the present invention to provide a process for obtaining thready materials, knitted goods, or woven goods, which have properties improved not only in flame resistance but also in mechanical properties such as tensile strength, tear resistance, and so on.

In order to attain the foregoing objects, according to an aspect of the present invention, the process for producing non-inflammable fiber materials comprises the steps of: obtaining thready materials, knitted goods, or woven goods, which are composed of a mixed yarn consisting of polymetaphenylene isophthalamide fibers of thermal decomposition temperature not smaller than 350° C. and rayon fibers, or which are composed 100 weight parts of a mixed yarn consisting of polymetaphenylene isophthalamide fibers of thermal decomposition temperature not smaller than 350° C. and rayon fibers, and from 20 to 100 weight parts of a polymetaphenylene isophthalamide fiber yarn of thermal decomposition temperature not smaller than 350° C., at least the rayon fibers in the thready materials, knitted goods, or woven goods being treated with one or more chemical agents selected from a first chemical agent group (a strength increasing agent) consisting of ammonium sulfamate, diammonium imidodisulfonate, ammonium sulfate, ammonium bisulfate, ammonium thiosulfate, ammonium sulfite, and ammonium bisulfite, and one or more chemical agents selected from a second chemical agent group (a flame resistance-improving agent) consisting of ammonium dihydrogen phosphate, diammonium hydrogen phosphate, and guanidine phosphate; and heat treating the thready materials, the knitted goods, or the woven goods at from 200° to 260° C. so as to denaturate the rayon fibers in the thready materials, the knitted goods, or the woven goods into thermally decomposed heat treated carbonized fibers.

DETAILED DESCRIPTION OF THE INVENTION

In the process according to the present invention, the thready materials, knitted goods, or woven goods used to be subjected to heat treatment are those which are composed of a mixed yarn consisting of polymethaphenylene isophthalamide fibers of thermal decomposition temperature not smaller than 350° C. and rayon fibers, or those which are composed of 100 weight parts of a mixed yarn consisting of polymetaphenylene isophthalamide fibers of thermal decomposition temperature not smaller than 350° C. and rayon fibers, and from 20 to 100 weight parts of a polymetaphenylene isophthalamide fiber yarn of thermal decomposition temperature not smaller than 350° C., and at least the rayon fibers contained in the above-mentioned thready materials, knitted goods, or woven goods are treated with one or more chemical agents selected from a first chemical agent group consisting of ammonium sulfamate, diammonium imidodisulfonate, ammonium sulfate, ammonium bisulfate, ammonium thiosulfate, ammonium sulfite, and ammonium bisulfite, and one or more chemical agents selected from a second chemical agent group consisting of ammonium dihydrogen phosphate, diammonium hydrogen phosphate, and guanidine phosphate. Therefore, it is possible to utilize any one of such a process in which the thready materials, knitted goods, or woven goods, which are to be heat treated, are obtained by using a spun rayon fiber yarn which has been subjected to the chemical agent treatment in advance, and such a process in which the whole of the thready materials, knitted goods, or woven goods, which are to be heat treated, are subjected to the chemical agent treatment.

As the mixed yarn consisting of polymetaphenylene isophthalamide fibers and rayon fibers composing the thready materials, the knitted goods, or the woven goods, which are used according to the present invention, may be, for example, a cored yarn obtained by winding a bundle of rayon staple fibers around a core yarn consisting of polymetaphenylene isophthalamide fibers; a covered yarn obtained by winding rayon thread around a core yarn consisting of polymetaphenylene isophthalamide fibers; a mixed-spun yarn consisting of rayon fibers and polymetaphenylene isophthalamide fibers; or the like.

As described above, the rayon fibers in the foregoing thready materials, knitted goods, or woven goods, are denatured into thermally decomposed heat treated carbonized fibers in the process of heat treatment, so that the thready materials, knitted goods, or woven goods employing the above-mentioned cored yarn or covered yarn as the mixed yarn consisting of the polymetaphenylne isophthalamide fibers and the rayon fibers are composed of the thermally decomposed heat treated carbonized fibers such that both the surfaces of the thready materials, the knitted goods, or the woven goods exhibit an improved property of fire-resistance, and that assurance of mechanical strength, which has been regarded as a weak point of the fibers, can be attained by the polymetaphenylene isophthalamide fibers composing the core yarn. Thus, it is possible to obtain the thready materials, knitted goods, or woven goods which exhibit a superior property of fire-resistance. Further, in the case where the mixed-spun yarn consisting of the polymetaphenylene isophthalamide fibers and the rayon fibers is utilized, the mixing ratio of the polymetaphenylene isophthalamide fibers causing reduction in fire-proof property should be made low. However, it is preferable to utilize the mixed-spun yarn including about from 10 to 50 weight percent polymetaphenylene isophthalamide fibers so that an effect of assurance of the mechanical strength due to the above-mentioned fibers can be realized.

As described above, the thready materials, knitted goods, or woven goods, which are used according to the present invention, may be composed of only the mixed yarn consisting of the polymetaphenylene isophthalamide fibers and the rayon fibers, or alternatively, may be composed of 100 weight parts of the above-mentioned mixed yarn and from 20 to 100 weight parts of polymetaphenylene isophthalamide fiber yarn. However, it is more preferable to utilize the thready materials, knitted goods, or woven goods, which are composed of only the mixed yarn consisting of the polymetaphenylne isophthalamide fibers and the rayon fibers, in the point of view that the polymetaphenylene isophthalamide fibers are expensive, and that the polymethaphenylene isophthalamide fibers are inferior in fire-proof property to the thermally decomposed heat treated carbonized fibers obtained from the rayon fibers so that the thready materials, knitted goods, or woven goods, containing the polymetaphenylene isophthalamide fibers as the component of high mixing ratio, have a tendency to reduce the fire-resistant property.

The polymetaphenylene isophthalamide fibers of thermal decomposition temperature not smaller than 350° C. included in the thready materials, goods, knitted goods, or woven goods, which are heat treated in the process according to the present invention, have not only such characteristics that they are not thermally decomposed when the rayon fibers included in the thready materials, knitted goods, or woven goods in denaturated into the thermally decomposed heat treated carbonized fibers, and moreover they are not fused at a high temperature, but also such characteristics that they are improved in strength represented, for example, by knot strength or the like as well as in fatigue-resistant property, and moreover they are not lowered in strength through heat treatment even when they are heat treated together with the rayon fibers which had been subjected to the foregoing chemical agent treatment in advance.

By the way, in the case where thready materials, knitted materials, or woven goods, which are composed of the rayon fibers, which had been subjected to the foregoing chemical agent treatment, and polyparaphenylene terephthalamide fibers, which are another kind of aromatic polyamide group fibers, are subjected to heat treatment, the strength is extremely lowered by the heat treatment. This is because the chemical agent adhering to the rayon fibers is decomposed at a high temperature of from 200° to 260° C. during the heat treatment so as to produce acids and bases which have strong reactivities to the polyparaphenylene terephthalamide fibers in the atmosphere of the above-mentioned high temperature, so that molecules of the polyparaphenylene terephthalamide fibers are cleaved so as to cause the reduction in strength of the same fibers. On the other hand, it is confirmed that in the case of the polymetaphenylene isophthalamide fibers utilized in the process according to the present invention, these fibers are stable against the acids and bases in the atmosphere of such a high temperature so that it is possible to obtain non-inflammable fiber materials having sufficient strength for practical use because they are not reduced in strength through the heat treatment.

Although the reason why the polymetaphenylene isophthalamide fibers utilized in the process according to the present invention are stable in the atmosphere of such a high temperature against the acids and bases which have been produced by the foregoing decomposition of chemical agent, is not clear, it will be presumed that this is because in a molecule of polymetaphenylene isophthalic acid, —NHCO groups are disposed in a meta-position of a benzene ring so that a cyclic structure is produced by the heat treatment at such a high temperature so as to stabilize the polymetaphenylene isophthalamide fibers.

Further, it is desirable that the heating temperature when the thready materials, knitted goods, or woven goods are heat treated is selected to be a value as low as possible in order to prevent reduction from occurring in strength of the polymetaphenylene isophthalamide fibers. In this case, however, it takes a long time for denaturating the rayon fibers into the carbonized fibers, and it is optimum to select the temperature to be from 200° to 260° C. in view of both these matters.

A specific constitution of the process according to the present invention will be described with reference to the following example.

EXAMPLE

Polymetaphenylne isophthalamide fibers (trade name: CONEX produced by Teijin, Ltd.; 2d×51 mm) and rayon staple fibers (produced by Nitto Boseki Co., Ltd.; 2d×51 mm) were mixed-spun in the ratio 50:50 (by weight) in an ordinary spinning process so as to obtain a spun yarn (English cotton count system 18/2's; the number of twist: lower twist 14.5 T/inch, upper twist 13.1 T/inch). Then, a herringbone weave cloth (width 1088 mm, weight 263 g/m$^2$; thread density 52×43 thread/inch) was obtained from the thus obtained spun yarns.

Next, the thus obtained weave cloth was soaked in a mixed salt solution dissolving 400 g/l of ammonium sulfate and 60 g/l of diammonium hydrogen phosphate, and then wrung and dried so as to obtain a dried cloth having a mixed salt adhesion rate of 38.5%.

Thereafter, the thus obtained dried cloth was heat treated in air at 250° C. for two hours, so as to obtain a weave cloth according to the present invention.

In Table 1, the values of various physical properties of the thus obtained non-inflammable fiber material are shown in comparison with the values obtained by testing a heat treated product from a weave cloth composed of 100% rayon fibers for reference. Here, the chemical agent treatment and heat treatment for the 100% rayon weave cloth were performed under the condition the same as that of the above-mentioned Example.

TABLE 1

| | | Example | Reference |
|---|---|---|---|
| Initial cloth weight before heat treatment (g/m$^2$) | | 284 | 300 |
| Cloth weight after heat treatment (g/m$^2$) | | 240 | 250 |
| Weaving manner | | twill weave | twill weave |
| Shrinkage rate (%) | warp | 7.3 | 6.0 |
| | weft | 7.2 | 15.2 |
| Tensil strength (kg/2.5 cm) | warp | 49 | 22 |
| | weft | 40 | 15 |
| Tear strength kg | warp | 10.2 | 1.0 |
| | weft | 9.8 | 0.9 |
| LOI | | 40 | 56 |

The shrinkage rate (%) in Table 1 means that of the weave cloth caused by the heat treatment. The LOI (an oxygen index number) is a value obtained by the following expression:

$$LOI = \frac{[O_2]}{[O_2] + [N_2]} \times 100$$

where $[O_2]$ and $[N_2]$ represent the minimum oxygen flow rate (l/min) and the nitrogen flow rate (l/min), respectively, which were read under a given condition after a test piece was made to flame (when it continued to burn for 3 minutes or more, or alternatively by the length of 50 mm or more), in accordance with the JIS (Japanese Industrial Standard) K7201, for macromolecular material burning test.

Further, description will be made for reference hereunder about tests which were conducted for confirming the fact that the reduction in strength of the polymetaphenylene isophthalamide fibers utilized according to the present invention hardly occurs when the fibers are heat treated under the existence of the chemical agent used for treating the rayon fibers, in comparison with the reduction in strength in the case where the polyparaphenylene terephthalamide fibers which belong to the same group of aromatic polyamide fibers are heat treated under the existence of the same chemical agent used for the treatment of the rayon fibers.

TEST 1:

The polyparaphenylene terephthalamide fibers (trade name: KEVLAR 29 produced by DuPont Japan Ltd.) and the polymetaphenylene isophthalamide fibers (trade name: CONEX produced by Teijin, Ltd.) were soaked in an aqueous solution dissolving 400 g/l of ammonium sulfamate, wrung, dried, and then heat treated at 260° C. in air for 1.5 hours. Changes in various physical properties of the fibers before and after the heat treatment are shown in Table 2.

TABLE 2

| | Polyparaphenylene terephthalamide fibers | | Polymetaphenylene isophthalamide fibers | |
|---|---|---|---|---|
| | Before heat treatment | After heat treatment | Before heat treatment | After heat treatment |
| Denier (d) | 1.64 | 1.71 | 1.98 | 1.93 |
| Dry tensile strength (g/d) | 13.9 | 1.37 | 5.84 | 5.44 |
| Dry elongation (%) | 2.60 | 0.38 | 28.8 | 29.4 |
| Wet tensile strength (g/d) | 10.1 | 1.19 | 4.55 | 4.47 |
| Wet elongation (%) | 2.70 | 0.48 | 32.8 | 30.0 |

TEST 2:

A plain weave cloth [A] composed of spun rayon yarn (12/2's) as warp and spun yarn (20/1's) consisting of the polyparaphenylne terephthalamide fibers (KEVLAR 29) as weft; a plain weave cloth [B] composed of spun yarn (30/1's) consisting of the polymetaphenylene isophthalamide fibers (CONEX) as weft; and a plain weave cloth [C] composed of spun rayon yarn (12/2's) as weft were individually soaked in an aqueous solution of a mixed salt comprising 385 g/l of ammonium imidosulfonate and 60 g/l of diammonium hydrogen phosphate, wrung, dried, and thereafter subjected to heat treatment at 250° C. in air for 2 hours. Changes in various physical properties of the respective weave clothes before and after the heat treatment are shown in Table 3.

TABLE 3

| | | Kind of plain weave cloth | | |
|---|---|---|---|---|
| | | [A] | [B] | [C] |
| Adhering rate of chemical agent (%) | | 33.9 | 39.0 | 35.5 |
| Weight (g/m$^2$) | Before heat treatment | 185 | 189 | 308 |
| | After heat treatment | 174 | 167 | 262 |
| Shrinking rate (%) | warp | 15.0 | 14.9 | 15.8 |
| | weft | 0 | 0 | 12.4 |
| Tensile strength (kg/2.5 cm) (weft direction) | Before heat treatment | 76.9 | 23.6 | 54.9 |
| | After heat treatment | 15.0 | 25.3 | 23.2 |
| Tensile strength reduction rate (%) before/after heat treatment (weft direction) | | 72 | 0 | 58 |

In Table 3, the shrinkage rate (%) is the rate of shrinkage of the woven cloth before and after the heat treatment, and the tensile strength shows values measured at a tensile speed of 50 mm/min by utilizing TENSILON UTM of type III.

The process for producing non-inflammable fiber materials according to the present invention is constituted as described above, in which the polymetaphenylene isophthalamide fibers which are non-fusible organic fibrs in the thready materials, knitted goods, or woven goods are hardly reduced in strength in the step of heat treating the rayon fibers, Therefore, there is such an effect or advantage that it is possible to obtain the non-inflammable fiber materials having characteristics improved not only in property of mechanical strength but also in property of flexing abrasion resistance as well as flexbility.

Further, the polymetaphenylene isophthalamide fibers utilized in the process according to the present invention are not only improved in spinning property but also inexpensive in cost of raw materials, in comparison with the polyparaphenylene terephthalamide fibers which belong to the same group of aromatic polyamide, and therefore there is also such a meritorious effect that the manufacturing can be easily effected.

While the invention has been described in detail and with reference to specific embodiments thereof, it will be apparent to one skilled in the art that various changes and modifications can be made therein without departing from the spirit and scope thereof.

What is claimed is:

1. A process for producing non-inflammable fiber materials comprising the steps of:

obtaining thready materials, knitted goods, or woven goods, which are composed of a mixed yarn consisting of polymetaphenylene isophthalamide fibers of thermal decomposition temperature not smaller than 350° C. and rayon fibers, with a range of 10 to 50 weight percent of polymetaphenylene isophthalamide fibers, based on the composition of the mixed yarn, wherein at least said rayon fibers in said thready materials, knitted goods, or woven goods are treated with one or more chemical agents selected from a first chemical agent group consisting of ammonium sulfamate, diammonium imidodisulfonate, ammonium sulfate, ammonium bisulfate, ammonium thiosulfate, ammonium sulfite and ammonium bisulfite, and one or more chemical agents selected from a second chemical group consisting of ammonium dihydrogen phosphate, diammonium hydrogen phosphate and guanidine phosphate; and heat treating said thready materials, said knitted goods, or said woven goods at from 200° to 260° C. so as to denaturate said rayon fibers in said thready material, said knitted goods, or said woven goods into thermally decomposed heat treated carbonized fibers.

2. A process for producing non-inflammable fiber materials according to claim 1, wherein said mixed yarn consisting of polymetaphenylene isophthalamide fibers of thermal decomposition temperature not smaller than 350° C. and said rayon fibers is selected one of a cored yarn obtained by winding a bundle of rayon short fibers around core yarn consisting of said polymetaphenylene isophthalamide fibers, a covered yarn obtained by winding rayon thread around a core yarn consisting of said polymetaphenylene isophthalamide, and a mixed-spun yarn consisting of said rayon fibers and said polymetaphenylene isophthalamide fibers.

3. A process for producing non-inflammable fiber materials according to claim 1, wherein at least one of warp and weft of said knitted goods or woven goods to be heat treated is composed of a mixed yarn consisting of said polymetaphenylene isophthalamide fibers of thermal decomposition temperature not smaller than 350° C. and said rayon fibers.

4. A non-inflammable fiber materials produced by a process according to claim 1.

* * * * *